US007441556B2

(12) United States Patent
Friesen et al.

(10) Patent No.: US 7,441,556 B2
(45) Date of Patent: Oct. 28, 2008

(54) PAINTBALL FEEDER

(76) Inventors: Brant Friesen, 404-44th Street East, Saskatoon, Saskatchewan (CA) S7K 0W1; Shawn Curtis, 404-44th Street East, Saskatoon, Saskatchewan (CA) S7K 0W1

( * ) Notice: Subject to any disclaimer, the term of this patent is extended or adjusted under 35 U.S.C. 154(b) by 98 days.

(21) Appl. No.: 11/332,046

(22) Filed: Jan. 13, 2006

(65) Prior Publication Data

US 2006/0157041 A1 Jul. 20, 2006

(30) Foreign Application Priority Data

Jan. 14, 2005 (CA) ..... 2492646

(51) Int. Cl.
*F41B 11/02* (2006.01)

(52) U.S. Cl. ..... 124/51.1

(58) Field of Classification Search ..... 89/33.01, 89/33.1, 33.17; 124/48, 49, 51.1, 73, 74
See application file for complete search history.

(56) References Cited

U.S. PATENT DOCUMENTS 1,223,386 A * 4/1917 Handelan ..... 473/436
2,528,945 A * 11/1950 Carpenter ..... 89/1.55
3,137,220 A * 6/1964 Smith ..... 404/98
4,025,071 A * 5/1977 Hodges ..... 473/436
4,352,348 A * 10/1982 Griffith ..... 124/78
5,520,171 A * 5/1996 David ..... 124/51.1
6,109,252 A * 8/2000 Stevens ..... 124/51.1
6,347,621 B1 2/2002 Guthrie
6,415,781 B1 7/2002 Perrone
6,609,511 B2 * 8/2003 Kotsiopoulos et al. ..... 124/51.1
6,978,776 B2 * 12/2005 Hamilton ..... 124/51.1
2007/0012304 A1 * 1/2007 van Dorsser et al. ..... 124/51.1
2007/0256676 A1 * 11/2007 Orvis et al. ..... 124/31

* cited by examiner

*Primary Examiner*—John Ricci
(74) *Attorney, Agent, or Firm*—Stites & Harbison, PLLC; David W. Nagle, Jr.

(57) ABSTRACT

A paintball feeding apparatus includes a paintball reservoir, and a housing mounted under the paintball reservoir with an inlet opening communicating with the paintball reservoir such that paintballs can move from the paintball reservoir though the inlet opening. The housing defines an outlet opening at a front end thereof adapted to be connected to a paintball gun feed tube. An auger is rotatably mounted in the housing such that pockets are formed between the auger flights, the pockets configured to receive and maintain a paintball in each pocket. A drive is operative to rotate the auger to move paintballs out the outlet opening.

14 Claims, 2 Drawing Sheets

PAINTBALL FEEDER

This invention relates to equipment used in the sport of paintball, and in particular paintball feeding systems for paintball guns.

BACKGROUND

In the sport of paintball opposing individuals or teams seeks to score points either through hitting a competitor with a "shot" or by hitting targets. Players may also act out military-style fantasy games in a safe manner through the sport of paintball.

Paintball guns typically include a semi-automatic loading system comprising a loading chamber on the top of the gun into which paintballs are poured, and which operates as a reservoir for ammunition. Individual paintballs drop through a hole in the bottom of the reservoir and through a feed tube connected to the firing chamber of the gun. A burst of compressed air fires the paintball by ejecting it through the gun barrel. As each paintball is fired, a new paintball drops into the firing chamber. For proper operation, in order to allow paintballs to be fired as quickly as the trigger can be pulled, the feed tube should always be full of paintballs, however the paintballs in the reservoir can jam at the entrance to the feed tube, such that no paintballs enter the feed tube.

Considerable prior art has been directed to either agitating the paintballs at the entrance to the feed tube in order to clear jams. U.S. Pat. No. 5,282,454 to Bell et al. discloses a sensor that detects a void in the feed tube, indicating a jam at the entrance. When such a void is detected, an agitator is activated to shift the paintballs at the entrance and free the jam. U.S. Pat. Nos. 6,415,781 and 6,418,919 to Perrone disclose similar jam detecting and clearing devices.

Other prior art discloses carousel or disc type mechanisms for positively feeding individual paint balls into the entrance to the firing chamber. See for example U.S. Pat. No. 6,347,621 to Guthrie, U.S. Pat. No. 6,488,019 to Kotsiopoulis, and U.S. Pat. No. 6,792,933 to Christopher et al.

SUMMARY OF THE INVENTION

It is an object of the present invention to provide a motorized paintball feeder apparatus that overcomes problems in the prior art.

The present invention provides, in a first embodiment, a paintball feeding apparatus comprising a paintball reservoir, and a housing mounted under the paintball reservoir and defining an inlet opening communicating with the paintball reservoir such that paintballs can move from the paintball reservoir though the inlet opening, and the housing defining an outlet opening at a front end thereof adapted to be connected to a paintball gun feed tube. An auger is rotatably mounted in the housing such that pockets are formed between the auger flights, the pockets configured to receive and maintain a paintball in each pocket such that a line through centers of paintballs in the pockets is substantially parallel to a rotational axis of the auger and aligned with the outlet opening. A drive is operative to rotate the auger, and a drive control is operative to activate the drive.

The present invention provides, in a second embodiment, a paintball feeding apparatus comprising a paintball reservoir, and a housing mounted under the paintball reservoir and defining an inlet opening communicating with the paintball reservoir such that paintballs can move from the paintball reservoir though the inlet opening; and the housing defining an outlet opening at a front end thereof adapted to be connected to a paintball gun feed tube, and the housing defining a trough extending rear ward from the outlet opening. A right twist auger and a left twist auger are rotatably mounted in the housing in a substantially parallel relationship to the trough such that pockets are formed between flights of each auger and above the trough, the pockets configured to receive and maintain a paintball in each pocket such that a line through centers of paintballs in the pockets is substantially parallel to a rotational axis of the augers and aligned with the outlet opening. A drive is operative to rotate the right twist auger and the left twist auger in opposite directions such that a paintball in a pocket moves in a forward direction, and a drive control is operative to activate the drive.

The present invention provides, in a third embodiment, a method of feeding paintballs from a paintball reservoir into a paintball gun feed tube. The method comprises mounting a housing under the paintball reservoir, the housing defining an inlet opening communicating with the paintball reservoir and the housing defining an outlet opening at a front end thereof connected to a paintball gun feed tube; rotatably mounting an auger in the housing such that pockets are formed between the auger flights, the pockets configured to receive and maintain a paintball in each pocket such that a line through centers of paintballs in the pockets is substantially parallel to a rotational axis of the auger and aligned with the outlet opening; depositing paintballs into the paintball reservoir such that paintballs move from the paintball reservoir though the inlet opening and into the pockets; rotating the auger to dispense paintballs through the outlet opening into the paintball gun feed tube, and to form empty pockets under a rear end of the inlet opening such that paintballs move from the paintball reservoir into the empty pockets and are carried to the front end of the housing and dispensed through the outlet opening into the paintball gun feed tube.

The feeder apparatus comprises an auger with a spacing between the flights thereof that substantially corresponds to the diameter of a paintball. The auger can be located adjacent to a wall oriented parallel to the auger axis such that a paintball fits in the space between the auger flights, in a pocket formed by the auger flights between the auger shaft and the wall. In the single auger embodiment, rotation of the auger moves the paintball along the wall and positively feeds it out the outlet opening into the feed tube.

Alternatively the paintball feeder apparatus comprises a pair of augers rotating together and oriented in a parallel side-by-side orientation. The augers are configured and coordinated such that pockets are formed between the flights of each auger and such that a paintball fits in each pocket. In the twin auger embodiment, the paintball is more positively displaced, as it is driven from both sides instead of just one. In order to increase the speed of delivery of paintballs to the feed tube the augers can conveniently be double flighted such that a single rotation of the augers will dispense two paintballs. Thus a motor with a slower rotational speed can be used to deliver a satisfactorily rapid delivery of paintballs.

The augers are oriented such that during rotation paintballs are drawn downward into the pockets. A diverter at the front end of the inlet opening diverts paintballs that might be moving along the top of the augers, above paintballs that have dropped into the pockets.

The augers can be rotated by a drive motor that turns on in response to a paintball detector in the feed tube, or in response to operation of the gun trigger or other stimulus.

DESCRIPTION OF THE DRAWINGS

While the invention is claimed in the concluding portions hereof, preferred embodiments are provided in the accompanying detailed description which may be best understood in conjunction with the accompanying diagrams where like parts in each of the several diagrams are labeled with like numbers, and where:

DETAILED DESCRIPTION OF THE ILLUSTRATED EMBODIMENTS

Figure 1:
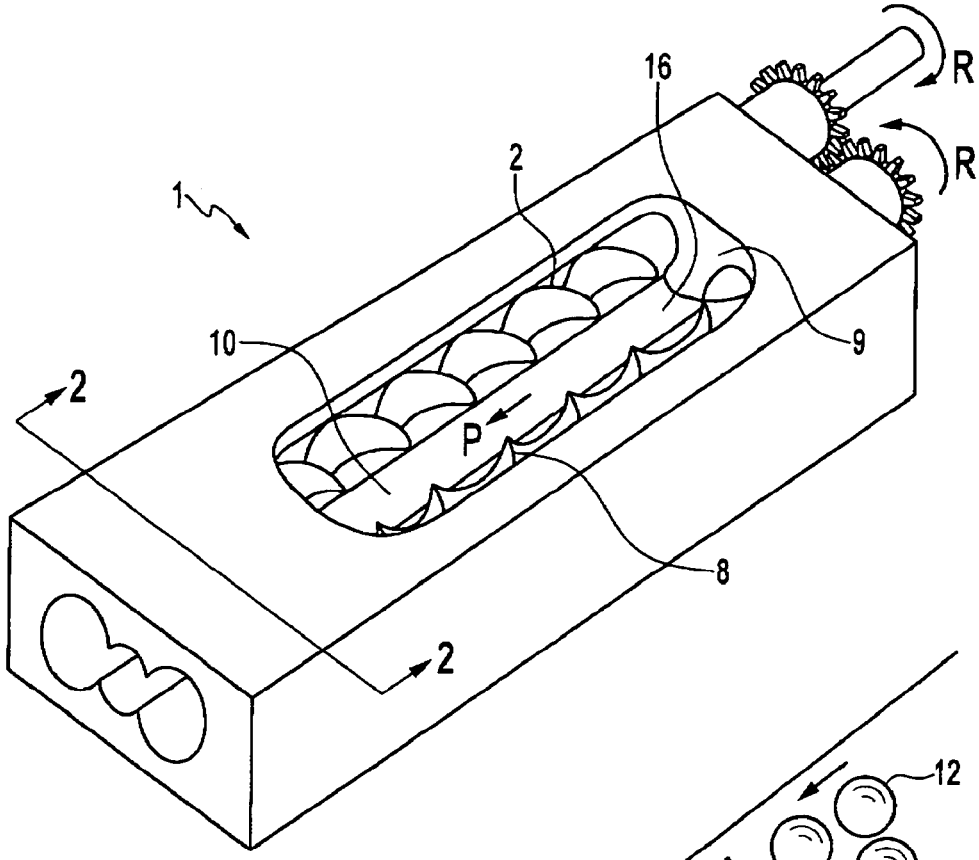
FIG. 1 is a schematic perspective view of an embodiment of the paintball feeder apparatus.

FIG. 1 illustrates a paintball feeder apparatus 1 of the present invention comprising a pair of augers 2 rotatably mounted in a housing 4 and oriented in a parallel side-by-side relationship. A drive comprises gears 6 attached to inner ends of the augers 2 that mesh such that the augers 2 rotate together in opposite directions as indicated by arrows R, and a drive motor connected to a driveshaft 7 on the rear end of one auger 2. An input opening 9 in the housing 4 allows paintballs to fall into contact with the augers 2.

Figure 5:
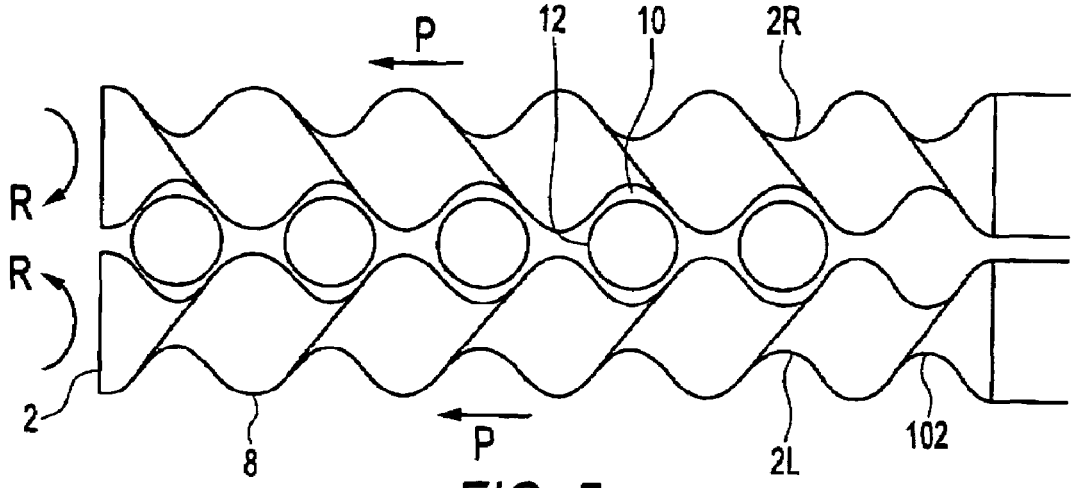
FIG. 5 is a schematic top view of the augers of the embodiment of FIG. 1.

As best seen in FIG. 5, the augers 2 are configured and coordinated such that the flights 8 of the augers 2 are aligned and a pocket 10 is formed between the flights of each auger 2 and such that a paintball 12 fits in the pocket 10. The apparatus 1 is configured such that paintballs 12 in the pockets 10 are oriented such that a line through the centers of the paintballs 12 is parallel to the rotational axes of the augers 2.

The augers 2 include a right auger 2R having a right hand twist such that the flights 8 thereof moves toward the front end of the housing 4 in forward direction P when the auger 2R is rotated in the indicated direction, and a left auger 2L having a left hand twist such that the flights 8 thereof also move toward the front end of the housing 4 in direction P when the auger 2L is rotated in the opposite direction as indicated. The augers 2 and drive gears 6 are coordinated so that the augers 2 rotate at the same speed and so that the flights 8 are oriented to maintain the formed pockets 10 as the augers 2 rotate.

Figure 2:
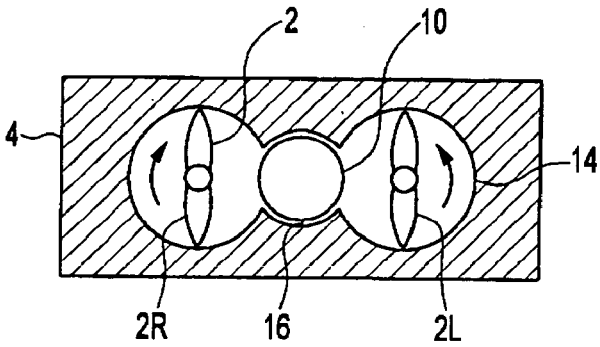
FIG. 2 is a schematic cross-sectional view along line 2-2 in FIG. 1.

As seen in FIG. 2 the augers 2 are mounted in auger channels 14 that correspond to the outside diameter of the augers 2, such that the auger channels 14, and apertures through the housing 4 at each end of the augers 2, act as bushings to maintain the augers 2 in the correct location. The auger channels 14 on each side of the housing 4 intersect a semi-cylindrical paintball trough 16 as illustrated. Thus the paintballs 12 move along the paintball trough 16 in response to the motion of the augers 2, and are pushed out the front end of the housing 4.

Figure 7:
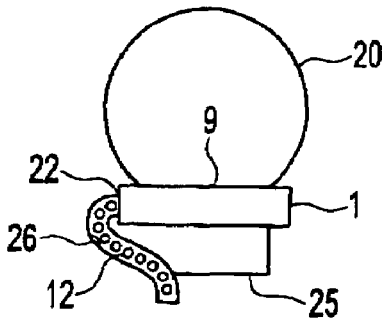
FIG. 7 is a schematic side view showing the feeder drive apparatus of FIG. 1 mounted on a paintball reservoir.

As illustrated in FIG. 7, the housing 4 is located at the bottom of a paintball reservoir 20 that is typically funneled or hoppered to direct paintballs to the inlet opening 9 which communicates with the reservoir 20 above the augers 2. An outlet opening 22 at the front of the housing 4 is connected to a feed tube 24 that is adapted for connection to a paintball gun in a conventional manner. In the illustrated embodiment the feed tube 24 curves back to allow the reservoir 20 to be moved forward and to be substantially balanced on the gun. An enclosure 25 can be provided under the housing for mounting the drive motor and any required electronics.

It is desired to keep the feed tube 24 filled with paintballs 12 such that same are always available for firing. A sensor 26 can be provided to sense when there is a gap in the feed tube 24, and cause the drive control to activate the drive motor to rotate the augers to feed more paintballs into the feed tube 24. Alternatively, the drive control and drive can be activated by the gun trigger, manually, or in response to other sensor signals.

In the twin auger paintball feeder apparatus 1 of FIG. 1, the paintball 12 is positively displaced, as it is driven from both sides instead of just one. In addition, as can be seen in FIG. 2, the inner edges of the flights 8 adjacent to the pockets 10 move downward during rotation tending to draw paintballs 12 into the pockets 10 to be moved along the paintball trough 16.

The augers 2 can be conventional single flight augers, however in order to increase the speed of delivery of paintballs 12 to the feed tube 24 the augers 2 are conveniently double flighted, as can be seen in FIG. 5, such that a single rotation of the augers 2 will dispense two paintballs 12. Thus a motor with a slower rotational speed can be used to deliver a satisfactorily rapid delivery of paintballs 12.

Figure 3:
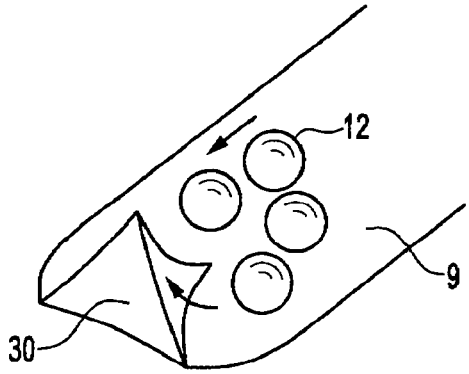
FIG. 3 is a schematic perspective view of a paintball diverter for use with the embodiment of FIG. 1.
Figure 4:
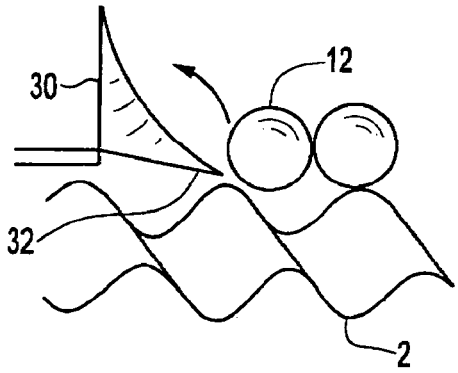
FIG. 4 is a schematic side view of the diverter of FIG. 3.

The inlet opening 9 extends from a rear portion of the housing 4 to a front portion of the housing above the augers 2 such that in operation upper paintballs 12 tend to ride along the top of the augers 2 and on top of lower paintballs 12 that are located in the pockets 10. In order to reduce jamming, a diverter 30, as illustrated in FIGS. 3 and 4, can be mounted at the front end of the inlet opening 9. The diverter 30 has a pointed end 32 located at the end of the inlet opening 9, and curves upward and outward from the pointed end 32 to divert the paintballs 12 upward and outward and reduce jamming at the end of the inlet opening 9.

Figure 6:
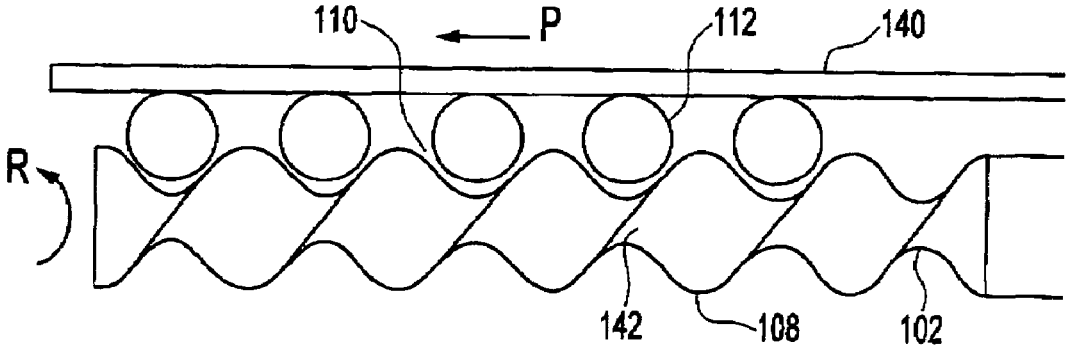
FIG. 6 is a schematic top view of the augers of an alternate embodiment.

An alternate single auger embodiment of a feeder dive apparatus 101 is illustrated in FIG. 6 comprising an auger 102 with a spacing between the flights 108 thereof that substantially corresponds to the diameter of a paintball 10. As in the embodiment of FIG. 1, the auger 102 is located at the bottom of a paintball reservoir and has an inlet opening communicating with the reservoir above the auger 102, and an outlet opening at a front end thereof connected to a feed tube. In this embodiment the auger 102 is located adjacent to a wall 140 oriented parallel to the axis of the auger 102 such that a paintball 112 fits in the pocket 110 between the auger flights 108, and between the auger shaft 142 and the wall 140. In this single auger embodiment, rotation of the auger 102 moves the paintball 112 along the wall 140 and feeds it out the outlet opening into the feed tube in the same manner as in the embodiment of FIG. 1, however feeding is not as aggressive since the paintball is subjected to the moving force of the auger 102 on only one side, and not both sides as in the prior embodiment.

Thus the foregoing is considered as illustrative only of the principles of the invention. Further, since numerous changes and modifications will readily occur to those skilled in the art, it is not desired to limit the invention to the exact construction and operation shown and described, and accordingly, all such suitable changes or modifications in structure or operation which may be resorted to are intended to fall within the scope of the claimed invention.

What is claimed is:

1. A paintball feeding apparatus comprising:

a paintball reservoir;

a housing mounted under the paintball reservoir and defining an inlet opening communicating with the paintball reservoir such that paintballs can move from the paintball reservoir though the inlet opening, and the housing defining an outlet opening at a front end thereof adapted to be connected to a paintball gun feed tube;

a right twist auger and a left twist auger rotatably mounted in the housing in a substantially parallel relationship wherein pockets are formed between flights of each auger, the pockets configured to receive and maintain a paintball in each pocket such that a line through centers of paintballs in the pockets is substantially parallel to a rotational axis of the augers and aligned with the outlet opening;

a drive operative to rotate the right twist auger and the left twist auger in opposite directions such that a paintball in a pocket moves in a forward direction; and a drive control operative to activate the drive.

2. The apparatus of claim 1 wherein the augers are rotated such that inner edges of the flights adjacent to the pockets move downward.

3. The apparatus of claim 1 wherein the housing defines a trough extending parallel to and between the right twist auger and the left twist auger, the trough configured such that paintballs in the pockets are supported by the trough and are substantially aligned with the outlet opening.

4. The apparatus of claim 1 wherein the augers are double lighted such that a single rotation of the augers will dispense two paintballs through the outlet opening.

5. The apparatus of claim 1 wherein the inlet opening extends from a rear portion of the housing to a front portion of the housing above the augers such that upper paintballs rest on lower paintballs in the pockets and the upper paintballs are carried in a forward direction by the lower paintballs, and wherein the housing comprises a diverter at a front end of the inlet opening operative to divert upper paintballs upward and outward to reduce jamming.

6. A paintball feeding apparatus comprising:

a paintball reservoir;

a housing mounted under the paintball reservoir and defining an inlet opening communicating with the paintball reservoir such that paintballs can move from the paintball reservoir though the inlet opening; and the housing defining an outlet opening at a front end thereof adapted to be connected to a paintball gun feed tube, and the housing defining a trough extending rear ward from the outlet opening;

a right twist auger and a left twist auger rotatably mounted in the housing in a substantially parallel relationship to the trough such that pockets are formed between flights of each auger and above the trough, the pockets configured to receive and maintain a paintball in each pocket such that a line through centers of paintballs in the pockets is substantially parallel to a rotational axis of the augers and aligned with the outlet opening;

a drive operative to rotate the right twist auger and the left twist auger in opposite directions such that a paintball in a pocket moves in a forward direction, and a drive control operative to activate the drive.

7. The apparatus of claim 6 wherein the augers are rotated such that inner edges of the flights adjacent to the pockets move downward.

8. The apparatus of claim 6 wherein the augers are double lighted such that a single rotation of the augers will dispense two paintballs through the outlet opening.

9. The apparatus of claim 6 wherein the inlet opening extends from a rear portion of the housing to a front portion of the housing above the augers such that upper paintballs rest on lower paintballs in the pockets and the upper paintballs are carried in a forward direction by the lower paintballs, and wherein the housing comprises a diverter at a front end of the inlet opening operative to divert upper paintballs upward and outward to reduce jamming.

10. A method of feeding paintballs from a paintball reservoir into a paintball gun feed tube, the method comprising:

mounting a housing under the paintball reservoir, the housing defining an inlet opening communicating with the paintball reservoir and the housing defining an outlet opening at a front end thereof connected to a paintball gun feed tube;

rotatably mounting a right twist auger and a left twist auger in the housing in a substantially parallel relationship such that the pockets are formed between flights of each auger the pockets configured to receive and maintain a paintball in each pocket such that a line through centers of paintballs in the pockets is substantially parallel to a rotational axis of the auger and aligned with the outlet opening;

depositing paintballs into the paintball reservoir such that paintballs move from the paintball reservoir though the inlet opening and into the pockets;

rotating the right twist auger and the left twist auger in opposite directions such that a paintball in a pocket moves in a forward direction such that the augers dispense paintballs through the outlet opening into the paintball gun feed tube, and the augers form empty pockets under a rear end of the inlet opening such that paintballs move from the paintball reservoir into the empty pockets and are carried to the front end of the housing and dispensed through the outlet opening into the paintball gun feed tube.

11. The method of claim 10 comprising rotating the augers such that inner edges of the flights adjacent to the pockets move downward to draw paintballs into the pockets.

12. The method of claim 10 wherein the housing defines a trough extending parallel to and between the right twist auger and the left twist auger, the trough configured such that paintballs in the pockets are supported by the trough and are substantially aligned with the outlet opening.

13. The method of claim 10 wherein the augers are double lighted such that a single rotation of the augers will dispense two paintballs through the outlet opening.

14. The method of claim 10 wherein the inlet opening extends from a rear portion of the housing to a front portion of the housing above the augers such that upper paintballs rest on lower paintballs in the pockets and are carried in a forward direction by the lower paintballs, and wherein the housing comprises a diverter at a front end of the inlet opening operative to divert upper paintballs upward and outward to reduce jamming.

* * * * *

UNITED STATES PATENT AND TRADEMARK OFFICE

CERTIFICATE OF CORRECTION

PATENT NO. : 7,441,556 B2
APPLICATION NO. : 11/332046
DATED : October 28, 2008
INVENTOR(S) : Friesen et al.

It is certified that error appears in the above-identified patent and that said Letters Patent is hereby corrected as shown below:

Claim 4, col. 5, line 20: Change the word "lighted" to "flighted"

Claim 8, col. 5, line 56: Change the word "lighted" to "flighted"

Claim 13, col. 6, line 46: Change the word "lighted" to "flighted"

Signed and Sealed this

Sixteenth Day of December, 2008

JON W. DUDAS
*Director of the United States Patent and Trademark Office*